US007886492B2

(12) United States Patent
Kelly et al.

(10) Patent No.: US 7,886,492 B2
(45) Date of Patent: Feb. 15, 2011

(54) POLE SYSTEM

(75) Inventors: Rick M. Kelly, Newark, OH (US); David A. Baum, Hebron, OH (US)

(73) Assignee: ABL IP Holding LLC, Conyers, GA (US)

( * ) Notice: Subject to any disclaimer, the term of this patent is extended or adjusted under 35 U.S.C. 154(b) by 381 days.

(21) Appl. No.: 11/262,100

(22) Filed: Oct. 28, 2005

(65) Prior Publication Data

US 2006/0092646 A1 May 4, 2006

Related U.S. Application Data

(60) Provisional application No. 60/623,739, filed on Oct. 29, 2004.

(51) Int. Cl.
*E02D 27/00* (2006.01)

(52) U.S. Cl. ..... 52/297; 52/710; 403/331

(58) Field of Classification Search ..... 52/40, 52/297, 726.4, 731.4, 736.1, 736.2, 653.2, 52/655.1, 710, 310, 656.9, 301; 248/519, 248/346.01; 403/252–255, 264, 331
See application file for complete search history.

(56) References Cited

U.S. PATENT DOCUMENTS

| | | | | |
|---|---|---|---|---|
| 3,045,783 | A | 7/1962 | Daniels | |
| 4,015,397 | A * | 4/1977 | Flachbarth et al. | 52/713 |
| 4,048,776 | A * | 9/1977 | Sato | 52/297 |
| 4,646,211 | A * | 2/1987 | Gallant et al. | 362/149 |
| 5,687,537 | A * | 11/1997 | Noble | 52/726.3 |
| 5,819,487 | A | 10/1998 | Bull et al. | |
| 6,167,673 | B1 | 1/2001 | Fournier | |
| D473,846 | S * | 4/2003 | Hellwig et al. | D13/139.5 |
| 6,685,157 | B1 | 2/2004 | Kennedy et al. | |
| 6,742,314 | B2 | 6/2004 | Young | |

FOREIGN PATENT DOCUMENTS

| | | |
|---|---|---|
| DE | 43 06 877 A1 | 3/1993 |
| DE | 43 06 877 A 1 | 3/1993 |
| DE | 299 01 506 U1 | 1/1999 |
| DE | 299 01 506 U 1 | 1/1999 |

(Continued)

OTHER PUBLICATIONS

International Search Report and Written Opinion of the International Searching Authority issued by the European Patent Office acting as the International Searching Authority in International Application No. PCT/US2005/039195, Mar. 21, 2006.

(Continued)

*Primary Examiner*—Jeanette E Chapman
*Assistant Examiner*—Daniel Kenny
(74) *Attorney, Agent, or Firm*—Kilpatrick Townsend & Stockton LLP

(57) ABSTRACT

A pole system comprises a shaft that includes tracks for mounting luminaires, street signs, bicycle racks, decorative signage, banners, traffic signals, pedestrian signals, or other items. In one embodiment, a pole system includes a shaft with two or more vertical tracks. Each track may have a dovetail shape and may be configured to receive mounting nuts for mounting items to the shaft. One or more vertical raceways separate from a center opening of the shaft may also be present.

19 Claims, 7 Drawing Sheets

FOREIGN PATENT DOCUMENTS

| | | | | |
|---|---|---|---|---|
| FR | 2 843 187 | A1 | | 2/2004 |
| FR | 2 843 187 | A1 | | 6/2004 |
| GB | 1579941 | | * | 11/1980 |
| WO | WO 2006/050235 | | | 5/2006 |

OTHER PUBLICATIONS

International Preliminary Report on Patentability issued by the International Bureau of WIPO in International Application No. PCT/US2005/039195, May 1, 2007.

* cited by examiner

POLE SYSTEM

This application claims priority to U.S. Provisional Application No. 60/623,739, filed Oct. 29, 2004, the entire contents of which are hereby incorporated by reference.

FIELD OF THE INVENTION

This invention relates to pole systems for outdoor use and, more particularly, pole systems with shafts that include tracks for mounting luminaires, street signs, and other items.

BACKGROUND OF THE INVENTION

Luminaire and similar pole systems are typically constructed of hollow pipe usually made of steel or aluminum, although bronze, cast iron, fiberglass, or other materials may be used. For years, cities, utility companies, and others have utilized metal pole systems erected to a vertical position and supported by making a hole in the ground, inserting the pole, and compacting ground around the base of the pole, or by securing the pole to a concrete surface, such as a sidewalk, or other foundation using anchor bolts and the like. The poles utilized have been selected based on their intended use; in other words, different poles have been used for mounting luminaires, street signs, traffic signals, or other pole-mounted items. This requires the manufacturer or purchaser of the items to be mounted to know the complete specifications of the shaft of the pole system prior to making or purchasing such items. Similarly, the manufacturer of the pole system would need to know beforehand the specifications of the item that a purchaser of the pole system desires to mount to the shaft in order to make the shaft the correct size and shape.

Additionally, when using poles for electrical applications, such as mounting luminaires, owners and electricians often encounter other considerations. For example, electrical codes do not permit the same raceway to be used for both high voltage wiring and low voltage wiring, which is a significant concern for both owners of pole systems and electricians installing pole systems. Thus, in existing systems, an additional vertical conduit is typically run along and attached to a pole. This is inconvenient, expensive, and sometimes unsightly.

Accordingly, there is a need for pole systems that are multi-purpose and may be used to mount luminaires, street signs, bicycle racks, decorative signage, banners, traffic signals, pedestrian signals, and/or other items without manufacturers and purchasers of pole systems and such mountable items being required to know specifications of available pole systems and items beforehand. Additionally, there is a need for pole systems with built-in, separate vertical passages to allow for the separation of high voltage wiring and low voltage wiring within the pole when both are required.

SUMMARY OF THE INVENTION

The present invention provides a pole system with a shaft that includes tracks for mounting luminaires, street signs, bicycle racks, decorative signage, banners, traffic signals, pedestrian signals, or other items. In one embodiment, a pole system includes a shaft with two or more vertical tracks. The tracks may have a dovetail shape and are configured to receive mounting nuts. A mounting nut is inserted within a track and rotated ninety degrees. In one embodiment, a mounting nut may have two clipped corners to allow the mounting nut to be rotated within the track. The other corners of the mounting nut are not clipped, preventing the nut from rotating beyond ninety degrees.

In one embodiment, a pole system for outdoor use comprises a shaft comprising at least two vertical tracks; at least one mounting nut with two clipped corners and configured to be received within one of the at least two vertical tracks for mounting items to the shaft; and a base shaped to receive the shaft, the base comprising slots that receive anchor bolts to secure the base to a surface and permit the base to be rotated up to about ten degrees during installation. The shaft of the pole system may have any of a number of shapes. The shaft may further comprise at least one vertical raceway separated from a center opening of the shaft. This allows both low voltage and high voltage wiring to be used within the same shaft by using, for example, high voltage wiring in the center opening of the shaft and low voltage wiring in the one or more raceways. In some embodiments, the shaft may have four vertical raceways, one in each corner of a shaft. The shaft may have four vertical tracks, each vertical raceway separated by a vertical track.

In some embodiments, the base includes recessed pockets within which the slots are formed. The recessed pockets may be configured such that anchor bolts installed through the slots do not extend above a top surface of the base. This allows the opening at the top of each recessed pocket to be covered with a small plate so that the anchor bolts are hidden from view. Certain embodiments of the pole system may also include a pole cap mounted at a top end of the shaft. The pole cap may be removably mounted. The pole cap may be mounted using one or more mounting nuts.

In another embodiment, a pole system for outdoor use comprises a shaft comprising an external surface with at least two vertical tracks, a center opening, and at least one vertical raceway separated from the center opening; and at least one mounting nut configured to be received within one of the at least two vertical tracks for mounting items to the shaft. The external surface of the shaft may include four vertical tracks, and the shaft may include four vertical raceways spaced between the vertical tracks. The pole system may further comprise a base shaped to receive the shaft. The base may have recessed pockets configured such that anchor bolts installed to secure the base to a foundation do not extend above a top surface of the base. Slots may be formed within the recessed pockets and configured such that they receive anchor bolts to secure the base to a surface and to permit the base to be rotated up to about ten degrees during installation. The pole system may include a removable pole cap for mounting at the top of the shaft.

In another embodiment, a pole system for outdoor use comprises a shaft comprising an external surface with at least two vertical tracks, a center opening, and at least one vertical raceway separated from the center opening; a plurality of mounting nuts configured to be received within one of the at least two vertical tracks for mounting items to the shaft; a base shaped to receive a bottom end of the shaft; and a pole cap removably mounted to a top end of the shaft. The external surface of the shaft may have four vertical tracks, and the shaft may include four vertical raceways spaced between the vertical tracks. The base may have recessed pockets within which slots are formed, the slots configured to receive anchor bolts to secure the base to a surface and to permit the base to be rotated up to about ten degrees during installation. Other embodiments are described and apparent from the further description of the invention below.

DETAILED DESCRIPTION OF THE INVENTION

Figure 1:
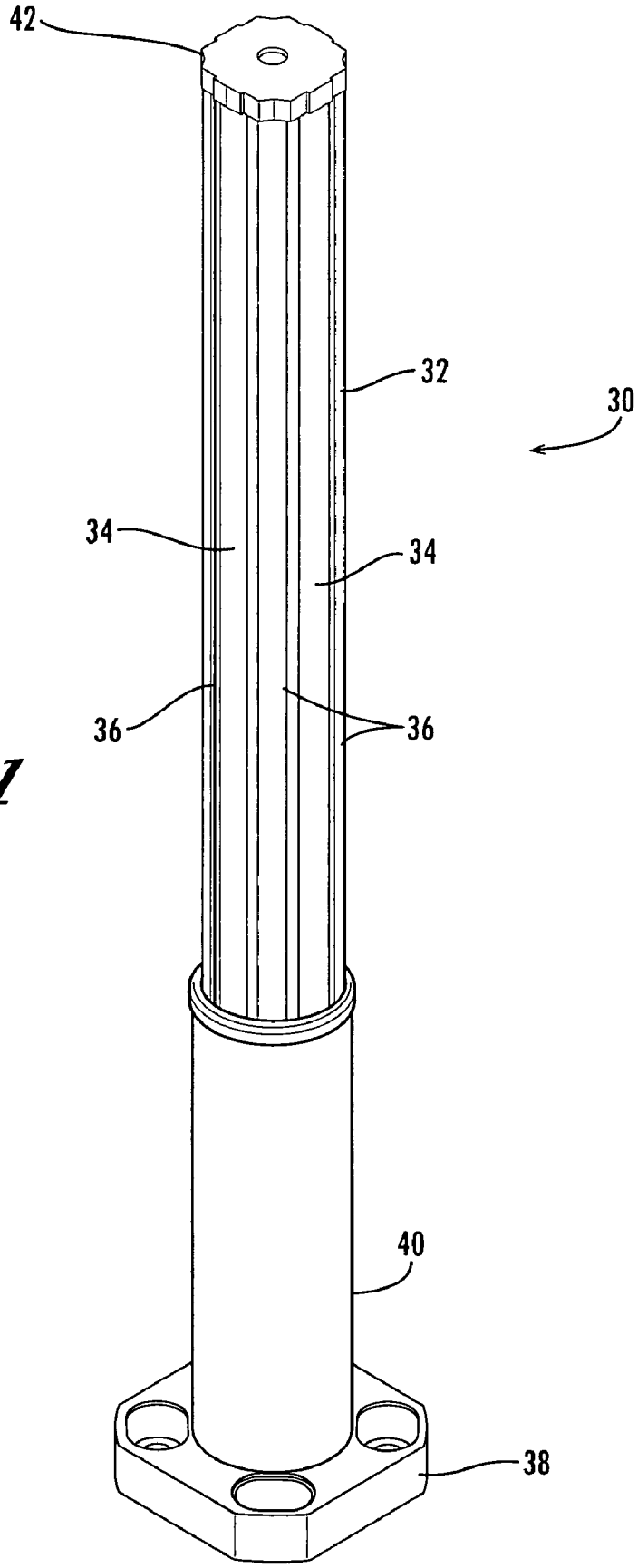
FIG. 1 is a perspective view of an exemplary embodiment of a pole system according to the present invention.
Figure 2:
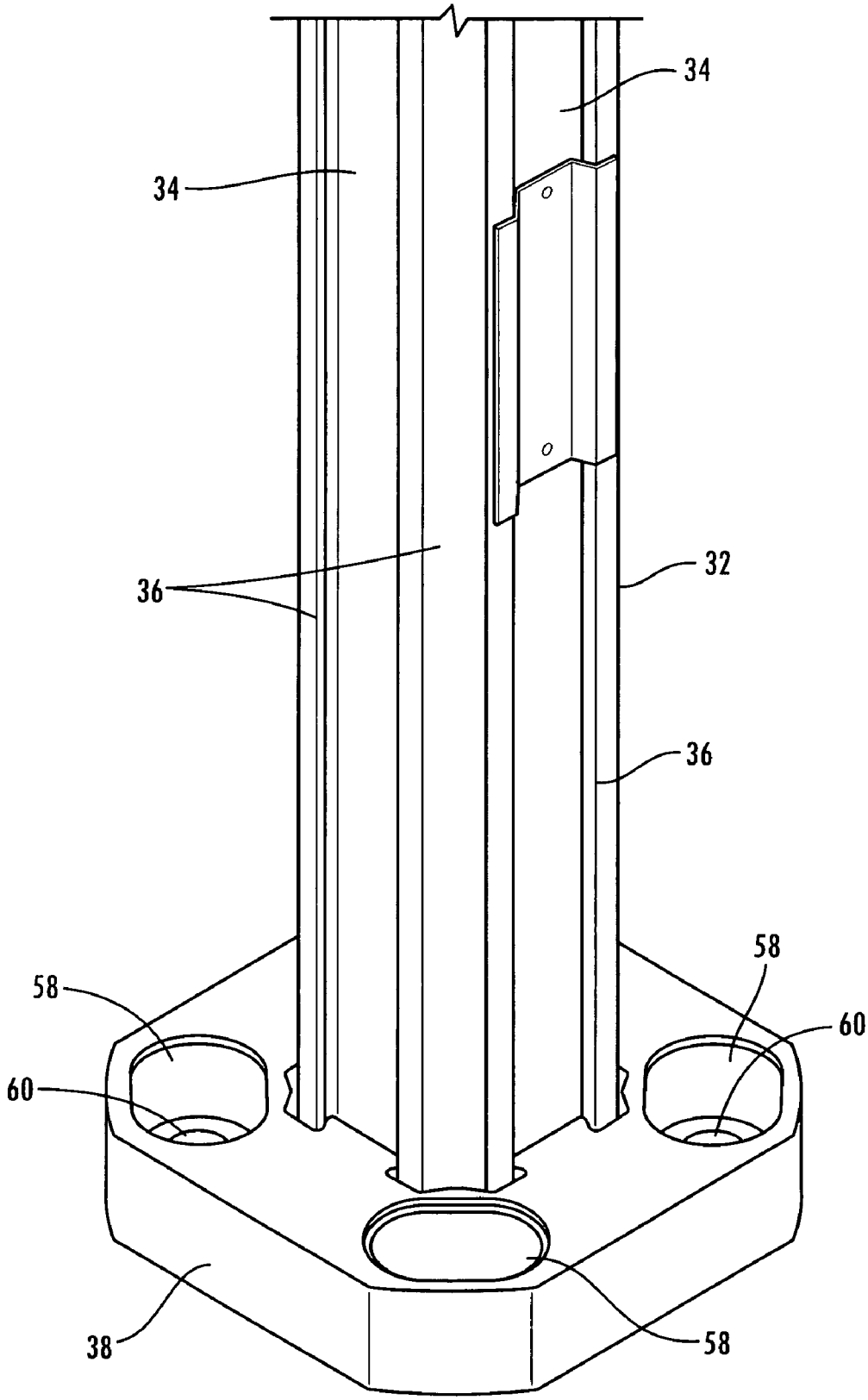
FIG. 2 is a partial perspective view of a shaft and a base of the pole system shown in FIG. 1.
Figure 3:
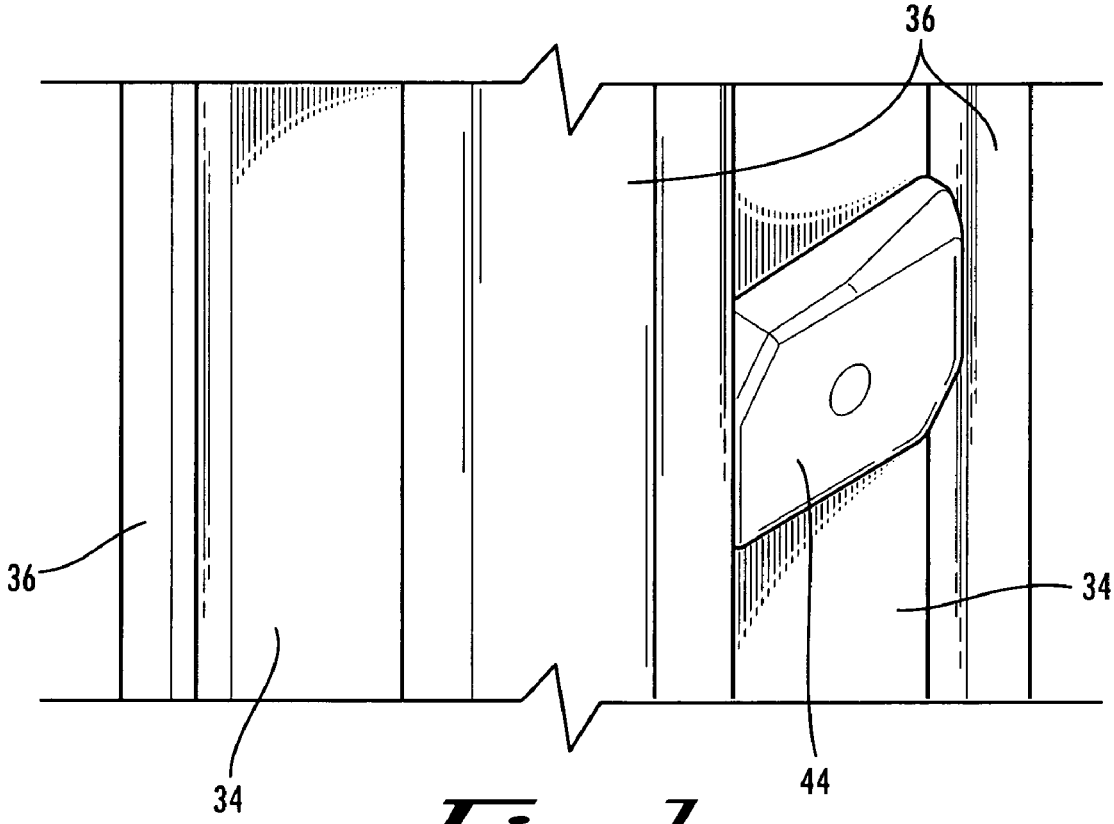
FIG. 3 is a partial perspective view of a mounting nut and a shaft of the pole system in FIG. 1.

FIG. 1 shows an exemplary embodiment of a pole system according to the present invention. A pole system 30 includes shaft 32 with tracks 34, center opening 35 (best seen in FIG. 4), and raceways 36. Shaft 32 is mounted in a base 38, and a portion of shaft 32 is surrounded by an outer cover 40. A pole cap 42 is mounted at the top of shaft 32. FIG. 2 is a partial perspective view that shows shaft 32 mounted within base 38, without outer cover 40 over a bottom portion of shaft 32. A mounting nut 44 for use in any of tracks 34 of shaft 32 is shown in FIG. 3. Exemplary embodiments of shaft 32 (including tracks 34 and raceways 36), base 38, pole cap 42, and mounting nut 44 are described in further detail below.

In an exemplary embodiment, shaft 32 is extruded from a high strength alloy, such as 6061-T6 aluminum alloy. As well understood by those skilled in the art, the "T6" heat treatment increases both the strength of the aluminum and the ability to machine it. Based on the ability to heat treat the extrusion to a "T6" condition throughout its thickness, a preferred wall thickness of shaft 32 may be up to about 0.25 inches. Other alloys or materials and wall thicknesses may be used, as is well understood by those skilled in the art, including those that are suitable for applications with lower strength requirements or that are easier to anodize.

Figure 4:
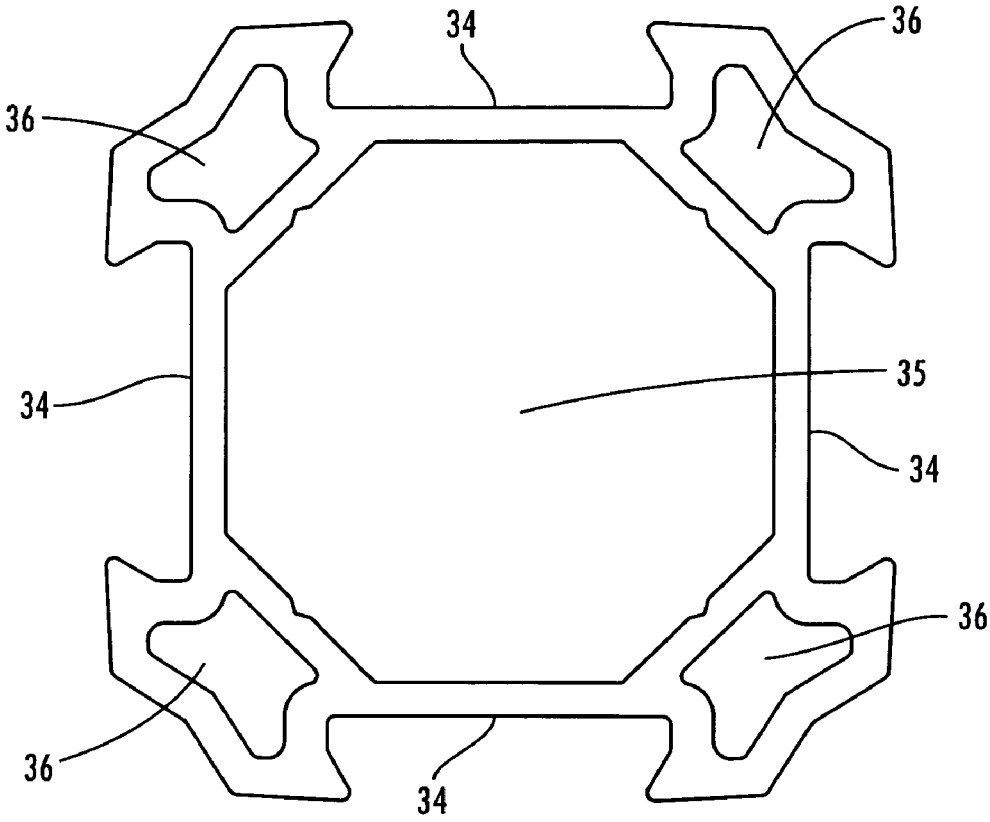
FIG. 4 is a top cross-sectional view of the shaft of the pole system of FIG. 1.

The shape of shaft 32 is shown in FIG. 4 and may be described as a modified generally square shape with multiple tracks located around its perimeter, with center opening 35 being generally octagon shaped. The surface between each track may be one of various shapes, including but not limited to internal flute, external flute, faceted, chamfer, radius, or others not specified herein. In the exemplary embodiment shown in FIG. 4, the surface is a faceted edge that appears to be an internal corner. This shape allows the sunlight to reflect off of shaft 32 at different angles and accentuates the appearance of shaft 32. In one embodiment, a cross-section of shaft 32 may be generally square shaped and include four tracks 34 located at ninety degrees to each other, but it should be understood that other shapes, including cylindrical, rectangular, polygonal, or combinations or modifications thereof, and numerous dimensions are suitable for a shaft in accordance with the principles of this invention. A shaft, such as shaft 32, is capable of handling relatively heavy loads, such as heavy luminaires and large signs that are mounted to the shaft. Shafts with a larger cross-section area may generally have a greater height. Suitable approximate cross-sectional dimensions of shaft 32 may be 5.75 inches by 5.75 inches, 8.5 inches by 8.5 inches, or any other dimension desired by the manufacturer or user of the pole system Shaft 32 also includes raceways 36, as shown in FIGS. 1-4. Raceways 36 are channels in each corner of shaft 32 that run vertically along the length of shaft 32 and are separated from central opening 35 of shaft 32. Raceways 36 provide flexibility for owners and electricians using shaft 32 for an outdoor lighting system or other application that requires electricity. For example, electrical codes do not permit the same raceway to be used for both high voltage and low voltage wiring, which is a significant concern for both owners of pole systems and electricians installing pole systems. Thus, in existing systems, an additional vertical conduit is typically run along and attached to a pole. However, the use of raceways 36 within shaft 32 eliminates the unsightly and expensive separate conduit. Low voltage wiring be run through one or more of raceways 36, while high voltage wiring may be run through center opening 35 of shaft 32, for example. As another example, communications lines may be run through one of raceways 36, separate from other wiring necessary to power and operate the luminaire or other devices mounted to the pole system. It should be understood that an embodiment of a shaft according to the present invention that includes tracks and vertical raceways may have a shape other than that shown in FIGS. 1-4, such as generally cylindrical, rectangular, hexagonal, octagonal, polygonal, modifications or combinations of the aforementioned, or others.

Figure 5:
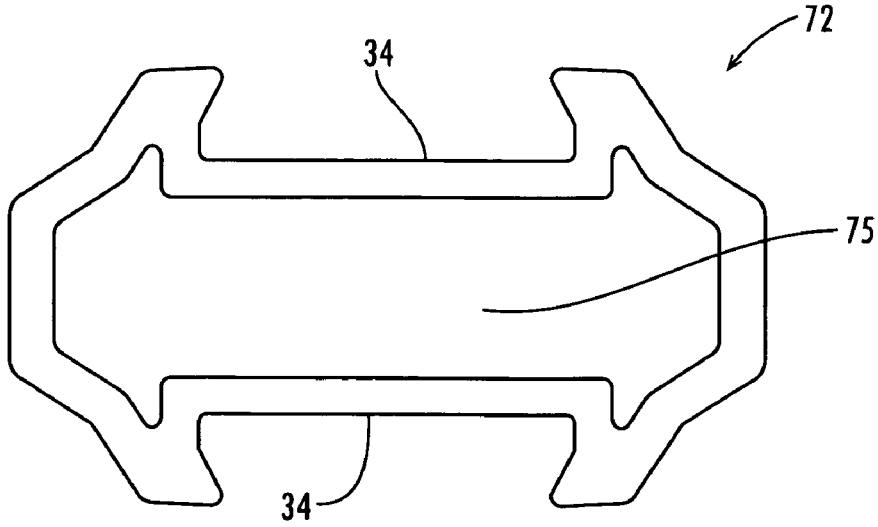
FIG. 5 is a top cross-sectional view of an alternative embodiment of a shaft of another embodiment of a pole system according to the present invention.

Another embodiment of a shaft of a pole system according to this invention is shown in cross-section in FIG. 5. In this embodiment, shaft 72 has a shape that may generally be described as rectangular. Shaft 72 includes center opening 75 and two tracks 34 located opposite each other but does not include any raceways. A shaft, such as shaft 72, may generally be used for handling relatively smaller loads, such as small luminaires and street signs, as compared with shaft 32 shown in FIGS. 1-4.

Tracks 34 and mounting nut 44 are shown in detail in FIGS. 3, 6, and 8A-8F. Tracks 34 are also shown in FIGS. 1-5. It should be understood that one or more mounting nuts, such as mounting nut 44, may be used with exemplary embodiments of pole systems according to this invention. A shaft of an exemplary pole system may include one or more tracks 34, such as shaft 32 that includes four tracks 34 and shaft 72 that includes two tracks. Each track 34 of a shaft should generally be of the same size and shape, although tracks of varying size or shape may be used on the same shaft. Exemplary track 34 described herein is just one example of a track that may be used according to this invention.

Each track 34 may be used to mount various components to a shaft of a pole system. Street signs, bicycle racks, luminaires, decorative signage, banners, traffic signals, pedestrian signals, or other items may be mounted to a shaft. Generally, track mounting systems, such as Unistrut® and others, are well known to those skilled in the art. The use of track mounting on a shaft of a pole system according to this invention permits the mounting of items to the shaft without the manufacturer or purchaser of the items to be mounted needing to know the complete specifications of the shaft of the pole system. Similarly, the use of track mounting allows the manufacturer of the pole system to make the pole system without having to know beforehand the specifications of the item that a purchaser of the pole system desires to mount to the shaft.

In one embodiment, track 34 is shaped similar to a dovetail. The flare of the dovetail allows the extrusion of shaft 32 to be contoured to add extra material to shaft 32 in an area that has a high localized stress in use. The dovetail shape is similar to the dovetail joint commonly used in woodworking.

Figure 6:
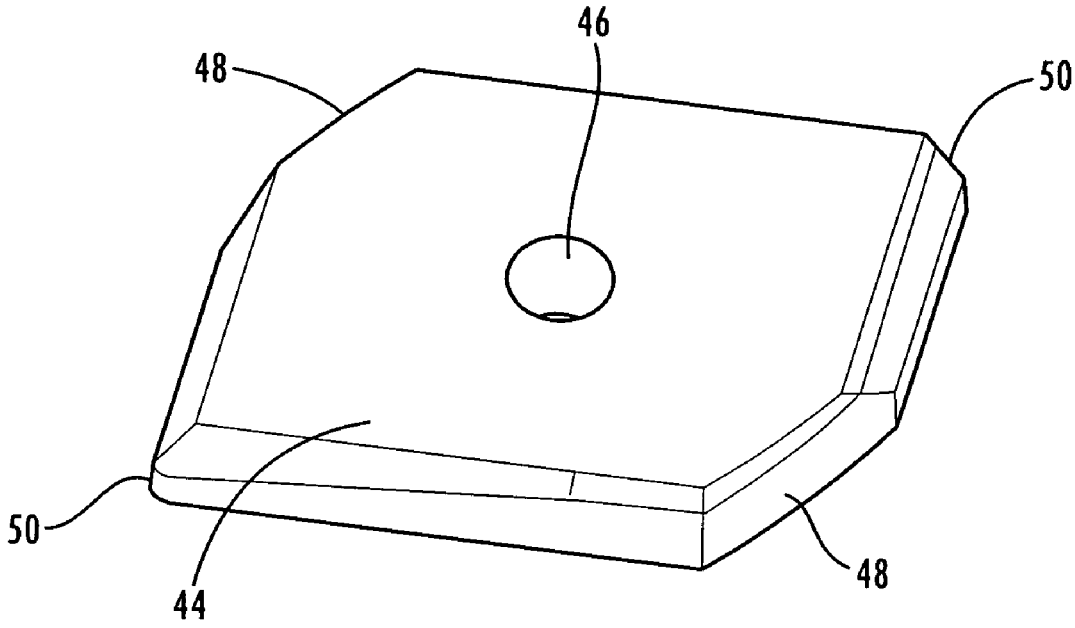
FIG. 6 is a perspective view of a mounting nut of an embodiment of a pole system of the present invention.

Mounting nut 44, shown in most detail in FIG. 6, is shaped such that a significant surface area of mounting nut 44 has contact with the surfaces of track 34 when received within track 34, as shown in FIGS. 8A-8F. In an embodiment, mounting nut 44 includes a hole 46 that may be threaded to receive a bolt or screw, such as bolt 52 that secures a bracket 54 to mounting nut 44 as shown in FIGS. 8A-8F. Mounting nut 44 has a generally rectangular shape with two clipped corners 48. Clipped corners 48 permit mounting nut 44 to rotate in track 34. Corners 50 stop mounting nut 44 from rotating further in track 34, once mounting nut 44 is in the ninety-degree position after insertion. Mounting nut 44 installed in track 34 of shaft 32 in the zero, forty-five, and ninety-degree positions is shown in FIGS. 8A-8F. Although shaft 32 is shown in FIGS. 8A-8F, it should be understood that mounting nut would operate similarly within shaft 72 shown in FIG. 5 or other shafts. It should also be understood, as shown in FIG. 8, that corners 50 may have rounded edges. In one embodiment, mounting nut 44 may be made from a casting and produced from 356-T6 aluminum alloy. Other alloys or materials may be used to increase strength and stainless steel may also be used. As noted above, mounting nut 44 may be used in combination with track 34 to mount numerous items to a shaft of a pole system.

Figure 9:
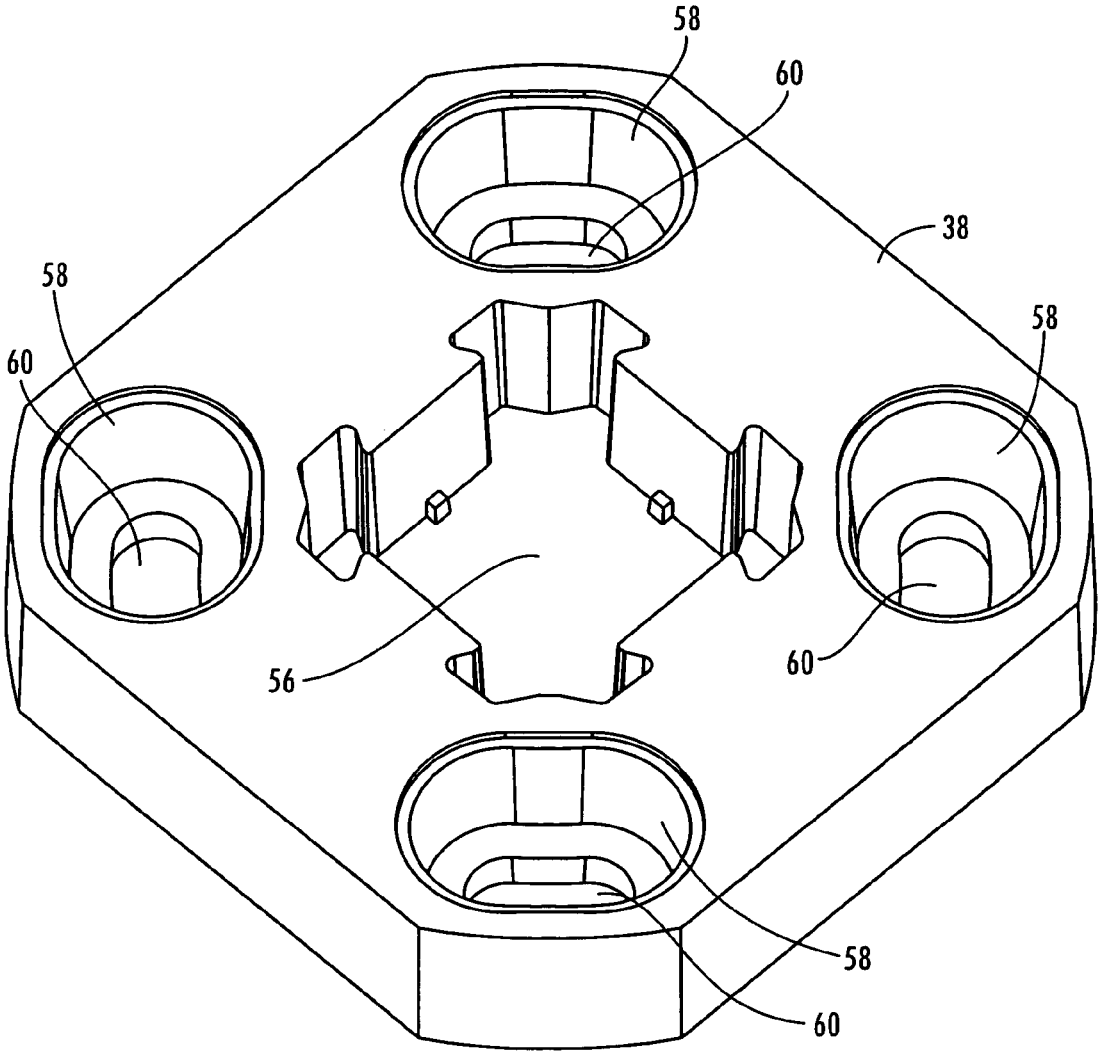
FIG. 9 is a perspective view of the base of the pole system of FIG. 1.

FIG. 9 is a perspective view of base 38, which is also shown in FIGS. 1 and 2. Base 38 has an interior opening 56 that is shaped to closely approximate the profile of shaft 32, aiding in the welding of shaft 32 to base 38. In one embodiment, base 38 may be a cast aluminum part produced from 356 aluminum alloy that is heat treated to enhance the strength.

Base 38 may include recessed pockets 58 that allow anchor bolts (not shown) that are used to secure base 38 into the ground to be hidden from view. Recessed pockets 58 permit installed bolts to be below the top surface of base 38. With these bolts being recessed, a small plate (not shown) may be used to cover the opening of each recessed pocket 58, thereby effectively hiding the bolts. Base plates for generally round and generally square poles that include recessed pockets similar to those described herein are available from Akron Foundry of Akron, Ohio. In an alternative embodiment, a base may be fabricated from plate material and would not include recessed pockets. Such a base may be desirable in situations where a customer wants to install a pole system on an existing foundation, or other applications that do not warrant the cost of producing new casting tooling.

Base 38 also includes slots 60 through which anchor bolts are inserted to secure base 38 to the ground. Slots 60 allow base 38 to be slightly repositioned during installation if desired. Slots 60 permit rotation of the base up to 5 degrees in either direction, unlike round holes that are typically used in bases to receive anchor bolts. The flexibility provided by slots 60 is significant because it is often difficult to properly install anchor bolts with the correct orientation.

Figure 7:
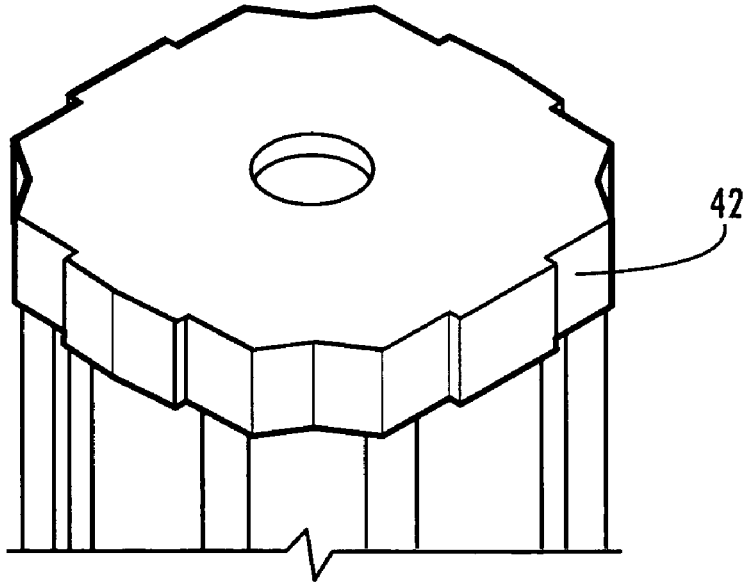
FIG. 7 is a perspective view of a pole cap of the pole system of FIG. 1.
Figure 8A:
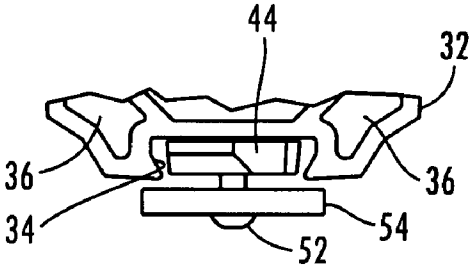
FIGS. 8A-8F show the mounting nut of FIG. 6 with the shaft shown in FIGS. 1-4.
Figure 8B:
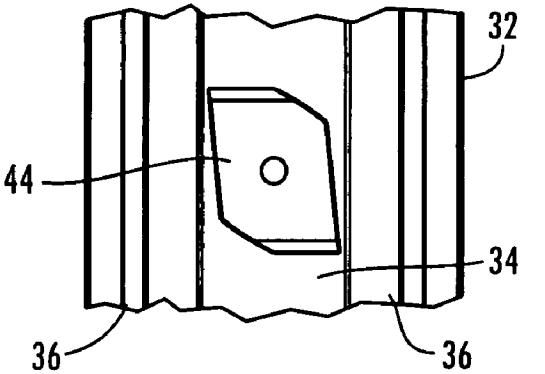
Figure 8C:
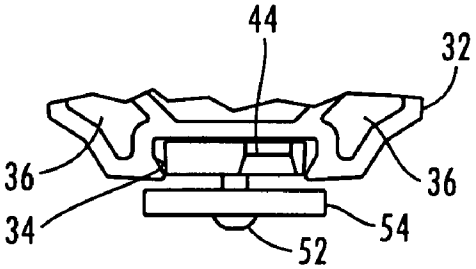
Figure 8D:
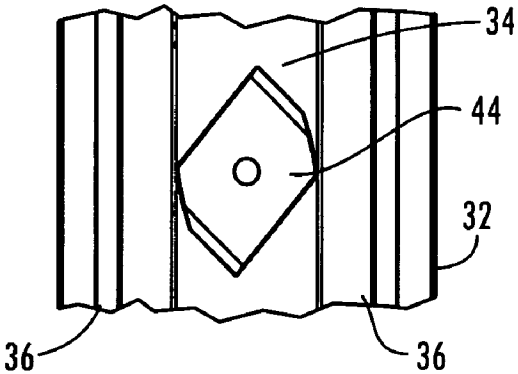
Figure 8E:
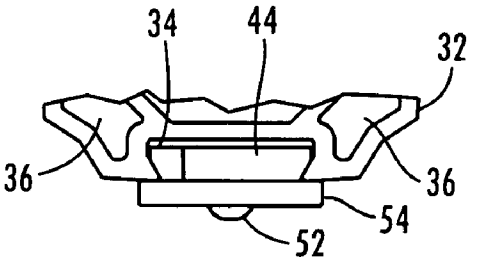
Figure 8F:
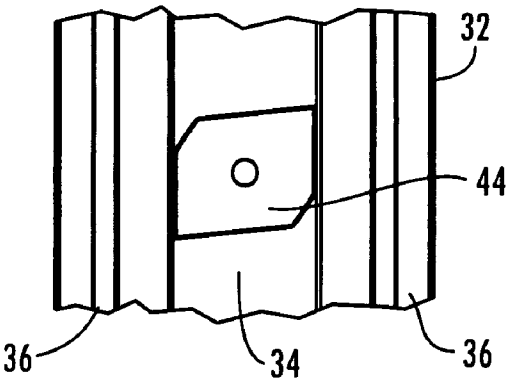

FIG. 7 is a perspective view of pole cap 42, which is also shown in FIG. 1. Pole cap 42 may be mounted in tracks 34 using one or more mounting nuts 44. Typically, the pole top style (with or without top tenon) is required to be known before a pole shaft is manufactured, which creates problems if the item mounted to the pole ever needs to be replaced or changed. In an embodiment of a pole system of this invention, securing pole cap 42 within tracks 34 of a shaft using one or more mounting nuts 44 provides flexibility because pole cap 42 may be easily replaced or changed in the field. Pole cap may have a flat top or come with a mounting tenon. A mounting tenon is typically used to mount luminaires or other components directly on top of the pole shaft, while a flat top is generally used when components will be mounted to the sides of the pole shaft only.

The foregoing description of the exemplary embodiments of the invention has been presented only for the purposes of illustration and description and is not intended to be exhaustive or to limit the invention to the precise forms disclosed. Many modifications and variations are possible in light of the above teaching. The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope.

What is claimed is:

1. A pole system for outdoor use comprising:

a shaft comprising:

(i) an external surface with a number of vertical tracks, (ii) a center opening defined by a number of sides, and (iii) a number of vertical raceways separated from the center opening, wherein the number of sides of the center opening equals the sum of the number of vertical tracks and the number of vertical raceways;

at least one mounting nut with two clipped corners and configured to be received within one of the number of vertical tracks;

a base comprising slots that receive anchor bolts to secure the base to a surface and permit the base to be rotated up to about ten degrees during installation;

an interior opening defined within the base having a cross-sectioned profile approximate to a cross-sectioned profile of the shaft, wherein an end of the shaft is inserted within the interior opening;

a first component mounted to a single one of the number of vertical tracks via the at least one mounting nut, wherein the first component comprises wiring that passes through the center opening of the shaft; and a second component mounted to another single one of the number of vertical tracks via the at least one mounting nut, wherein the second component comprises wiring that passes through one of the number of vertical raceways of the shaft.

2. The pole system of claim 1, wherein the wiring from the first component comprises a first voltage and the wiring from the second component comprises a second voltage.

3. The pole system of claim 2, wherein the shaft further comprises four vertical raceways, one in each corner of the shaft.

4. The pole system of claim 3, wherein the shaft further comprises four vertical tracks, each vertical raceway separated by a vertical track.

5. The pole system of claim 1, wherein the base further comprises recessed pockets within which the slots are formed.

6. The pole system of claim 5, wherein the recessed pockets are configured such that anchor bolts installed through the slots do not extend above a top surface of the base.

7. The pole system of claim 1, wherein the at least one mounting nut comprises a plurality of mounting nuts.

8. The pole system of claim 7, further comprising a pole cap mounted at a top end of the shaft using at least one of the plurality of mounting nuts.

9. The pole system of claim 1, further comprising a removable pole cap for mounting at a top end of the shaft.

10. The pole system of claim 1, wherein the shaft has a generally polygonal shape.

11. The pole system of claim 10, wherein the shaft has a generally square shape.

12. A pole system for outdoor use comprising:

a shaft comprising:

(i) an external surface with a number of vertical tracks, (ii) a center opening defined by a number of sides, and (iii) a number of vertical raceways separated from the center opening, wherein the number of sides of the center opening equals the sum of the number of vertical tracks and the number of vertical raceways;

at least one mounting nut configured to be received within one of the number of vertical tracks;

a base having an interior opening, the interior opening having a cross-sectioned profile approximate to a cross-sectioned profile of the shaft, wherein an end of the shaft is inserted within the interior opening;

a first component mounted to a single one of the number of vertical tracks via the at least one mounting nut, wherein the first component comprises wiring that passes through the center opening of the shaft; and a second component mounted to another single one of the number of vertical tracks via the at least one mounting nut, wherein the second component comprises wiring that passes through one of the number of vertical raceways of the shaft.

13. The pole system of claim 12, wherein the external surface of the shaft comprises four vertical tracks and the shaft further comprises four vertical raceways spaced between the vertical tracks.

14. The pole system of claim 12, further comprising a removable pole cap for mounting at the top of the shaft.

15. The pole system of claim 12, wherein the base comprises recessed pockets within which slots are formed, the slots configured to receive anchor bolts to secure the base to a surface and to permit the base to be rotated up to about ten degrees during installation.

16. The pole system of claim 12, wherein the wiring from the first component comprises a first voltage and the wiring from the second component comprises a second voltage.

17. A pole system for outdoor use comprising:

a shaft comprising:

(i) an external surface with a number of vertical tracks, (ii) a center opening defined by a number of sides, and (iii) a number of vertical raceways separated from the center opening, wherein the number of sides of the center opening equals the sum of the number of vertical tracks and the number of vertical raceways;

a plurality of mounting nuts configured to be received within one of the number of vertical tracks;

a first component mounted to a single one of the number of vertical tracks via one of the plurality of mounting nuts, wherein the first component comprises wiring that passes through the center opening of the shaft; and a second component mounted to another single one of the number of vertical tracks via one of the plurality of mounting nuts, wherein the second component comprises wiring that passes through one of the number of vertical raceways of the shaft.

18. The pole system of claim 17, wherein the external surface of the shaft comprises four vertical tracks and the shaft further comprises four vertical raceways spaced between the vertical tracks, and wherein the wiring from the first component comprises a first voltage and the wiring from the second component comprises a second voltage.

19. The pole system of claim 18, further comprising:

a base having an interior opening, the interior opening having a cross sectioned profile approximate to a cross sectioned profile of the shaft, wherein the base comprises recessed pockets within which slots are formed, the slots configured to receive anchor bolts to secure the base to a surface and to permit the base to be rotated up to about ten degrees during installation; and a removable pole cap mounted to a top end of the shaft, wherein an end of the shaft is inserted within the interior opening.

* * * * *